US006270540B1

(12) United States Patent
Lin et al.

(10) Patent No.: US 6,270,540 B1
(45) Date of Patent: Aug. 7, 2001

(54) STAR-LIKE POLY(OXYALKYENE) TRIAMIDE ALKOXYLATES GASOLINE ADDITIVE AND THE METHOD FOR PRODUCING THE SAME

(75) Inventors: Jiang-Jen Lin; I-Fun Su, both of Taichung; Kun-Hai Lin, Chiayi; Yung-Sheng Ho, Chiayi; Che-Nan Lee, Chiayi; Wen-Jei Shiu, Chiayi; Wei-Shiun Ku, Chiayi, all of (TW)

(73) Assignee: Chinese Petroleum Corporation, Taipei (TW)

( * ) Notice: Subject to any disclaimer, the term of this patent is extended or adjusted under 35 U.S.C. 154(b) by 0 days.

(21) Appl. No.: 09/411,651

(22) Filed: Oct. 4, 1999

(51) Int. Cl.[7] ..... C10L 1/18; C10L 1/22

(52) U.S. Cl. ..... 44/418; 44/419; 564/153; 564/159; 564/160

(58) Field of Search ..... 44/418, 419; 564/153, 564/159, 160

(56) References Cited

U.S. PATENT DOCUMENTS 3,839,372 * 10/1974 Schneider ..... 260/404.5
4,619,775 * 10/1986 Steltenkamp ..... 514/153
5,855,630 * 1/1999 Lin ..... 44/419

* cited by examiner

*Primary Examiner*—Margaret Medley
*Assistant Examiner*—Cephia D. Toomer
(74) *Attorney, Agent, or Firm*—Foley & Lardner

(57) ABSTRACT

A new class of useful gasoline additives is prepared via two consecutive reactions including: (1) amidation of water-soluble hydrophilic, low molecular weight triamine with alkyl acetate at an elevated temperature under $N_2$ pressure to prepare a symmetrical triamide; and (2) alkoxylation of the triamides with 1,2-epoxyalkane to prepare poly (oxyalkylene)triamide alkoxylate of three telechelic hydroxy groups, having the general formula:

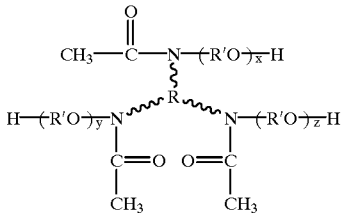

wherein x, y and z are from 1 to 20, R is poly(oxyalkylene) of a molecular weight from 72 to 1000, and R' is an alkyl having a carbon number from 2 to 18.

15 Claims, No Drawings

STAR-LIKE POLY(OXYALKYENE) TRIAMIDE ALKOXYLATES GASOLINE ADDITIVE AND THE METHOD FOR PRODUCING THE SAME

BACKGROUND OF THE INVENTION

1. Field of the Invention

This invention relates to a gasoline additive and the method for producing the same, more particularly to a poly(oxyalkylene)triamide alkoxylates gasoline additive and the method for producing the same. The triamide alkoxylates are particularly tri-hydroxytelechelic oxybutoxylate oligomers.

2. Description of the Related Art

Many kinds of compounds have been used as an additive for hydrocarbon fuels, e.g., fuels in the gasoline boiling range for preventing deposits in engines, controlling octane requirement increases and reducing octane requirement. U.S. Pat. No. 4,236,020, assigned to Chevron Research Company, discloses compounds for use as deposit control additives in internal combustion engines that comprise poly (oxyalkylene) carbamates. U.S. Pat. No. 5,352,251, assigned to Shell Oil Company, discloses the use of cyclic amide alkoxylate compounds as additives in fuel compositions. U.S. Pat. No. 5,855,630, assigned to Shell Oil company, discloses the use of multiple amide polyether alcohols as gasoline additive to reduce intake value deposits. However, these conventional additive compounds are oil-soluble and have high molecular weight, single hydrophilic group and single hydrophobic group per molecule.

U.S. co-pending patent application Ser. No. 09/211,311, assigned to Chinese Petroleum Corporation, discloses a poly(oxyalkylene)diamide alkoxylates gasoline additive with a Gemini structure, the disclosure of which is incorporated herein by reference. The Gemini surfactants have two hydrophilic groups and two hydrophobic groups per molecule, rather than the single hydrophilic group and single hydrophobic group per molecule of the conventional fuel additive compounds. The Gemini surfactants, compared to conventional surfactants with the same equivalent number of carbon atoms per hydrophilic group, have unexpected properties of unusually low critical micelle concentration and $C_{20}$ values in aqueous media. Therefore, the Gemini surfactants are more efficient in reducing surface tension and have better solubility in water aid in formulating products. Furthermore, the Gemini surfactants have a positive affect on reducing octane requirement of engines.

It is desired to provide a new composition of gasoline-soluble additive compounds that can achieve good performance as the conventional high molecular weight and oil-soluble additive compounds while used in less amounts as compared to the conventional additive compounds.

SUMMARY OF THE INVENTION

The object of the present invention is to provide a new class of additive compounds useful for hydrocarbon fuels that show a good performance in decreasing intake valve deposits, positively affecting the engine octane requirement, reducing the combustion chamber deposits and preventing haze formation in the fuel, as well as a method for producing the same.

The surfactancy and the performance in engine test are generally correlated with the butoxylate structural shapes, functionality and molecular weight. In other words, the hydrophilic-hydrophobic balance is related to the content of amide, hydroxy, oxybutylene group and their orientation. A structure of three hydroxy telechelic groups and three amide in a symmetric shape is different from a dihydroxy telechelic group of same molecular weight.

According to one aspect of the present invention, a gasoline additive comprises a compound having the general formula:

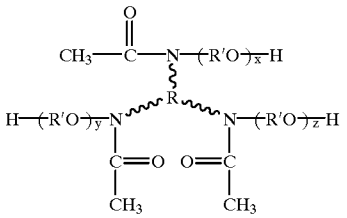

wherein x, y and z are from 1 to 20, R is poly(oxyalkylene) of a molecular weight from 72 to 1000, particularly the poly(oxyalkylene) group can be poly(oxyethylene), poly (oxypropylene) and poly(oxybutylene), and R' is an alkyl having a carbon number from 2 to 18.

The structure is further defined by three amide polar center, and three poly(oxyalkylene) nonpolar tails. The star-like structure is consisting of three equal distance arms from the center of hydrophilic groups. The star-like structures have generally low viscosity in comparing with linear analogs of similar molecular weight.

According to another aspect of the present invention, a method for producing a gasoline additive comprises the steps of:

(1) preparing a poly(oxyalkylene)triamide compound having the general formula:

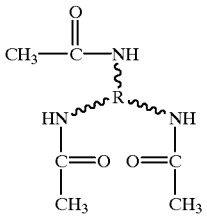

by amidation of an alkyl acetate with a triamine; and (2) alkoxylation of said triamide compound with 1,2-epoxyalkane.

According to still another aspect of the present invention, a fuel composition comprises a mixture of a major amount of hydrocarbons in the gasoline boiling range and a minor amount of a gasoline additive comprising a compound having the general formula:

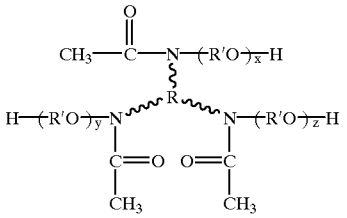

wherein x, y and z are from 1 to 20, R is poly(oxyalkylene) of a molecular weight from 72 to 1000, and R' is an alkyl having a carbon number from 2 to 18.

Several non-limiting illustrative examples for producing the gasoline additive of the present invention are discussed hereinbelow.

Experimental Procedures for the Synthesis of Poly (oxyalkyene)triamide Alkoxylates Gasoline Additives

EXAMPLE 1

Gasoline Additive (Triamides with Three Butoxylate Arms)

First Step: Prepare Triamide from JeffamineT-403 and Ethyl Acetate (Jeffamine T-403: Triol-initiated triamine with Mwt of 400)

1. A mixture of T-403 (118.03 g, 0.2929 mole) and ethyl acetate (232 g) was added into a one liter autoclave.
2. The autoclave was sealed and purged of air by pressurizing and depressurizing with nitrogen at 500 psi to 50 psi several times, with stirring.
3. Under an initial nitrogen pressure of 200 psi, the mixture was heated slowly to 180° C. and held at this temperature for over 15 hours. During the process, the pressure increased gradually to 403 psi at 180° C. Then, the pressure decreased with time because ethyl acetate changed to liquid phase from vapor phase.
4. After the pressure stopped decreasing for about 8 hours, the mixture was then cooled to ambient temperature. The excess gas was vented, and the product was recovered as a light brown liquid. The crude product was rotovapped at 70° C. to remove ethyl acetate. The recovery ratio was 92%. The reaction is shown as follows:

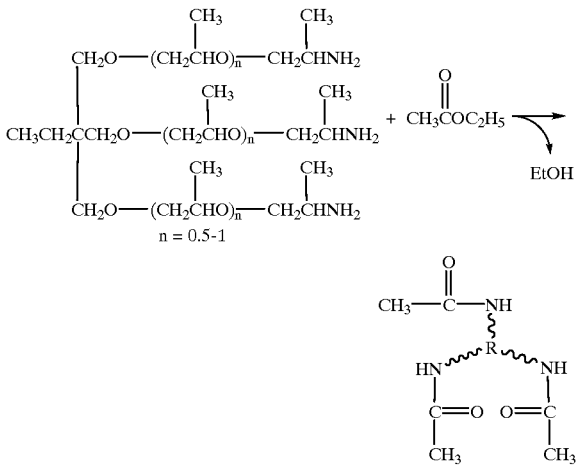

wherein x is from 1 to 20, and R is poly(oxypropylene) of a molecular weight from 72 to 1000.

Second Step: Butoxylation of Triamide

1. A mixture of Triamide (65.75 g, 0.125 mole), potassium hydroxide (0.5741 g) and 1,2-epoxybutane(134.25 g, 1.86 moles) was added into a one liter autoclave.
2. The autoclave was sealed and purged of air by pressurizing and depressurizing with nitrogen at 500 psi to 50 psi several times, with stirring.
3. Under an initial nitrogen pressure of 500 psi, the mixture was heated slowly to 120° C. and held at this temperature for over 16 hours. During the process, a maximum pressure was measured to be 613 psi at 120° C. Then, the pressure decreased with time because 1,2-epoxybutane changed to liquid phase from vapor phase.
4. After the pressure stopped decreasing for about 9 hours, the mixture was then cooled to ambient temperature. The excess gas was vented, and the product was recovered as a light brown liquid. The crude product was rotovapped at 90° C. to remove 1,2-epoxybutane. The weight of the crude product was 192.73 g. The recovery ratio was 96%.
5. The product was extracted by distilled water in order to remove $K^+$. Analysis of GPC, NMR and IR for the product was conducted. IR: 1735 $cm^{-1}$ and 1650 $cm^{-1}$ carbonyl absorption and 1100 $cm^{-1}$ ether absorption. The estimated molecular weight was 1600. GPC analysis indicated the average molecular weight (Mw) was 1696 and the poly-dispersity was 1.15. The butoxylation reaction is shown as follows:

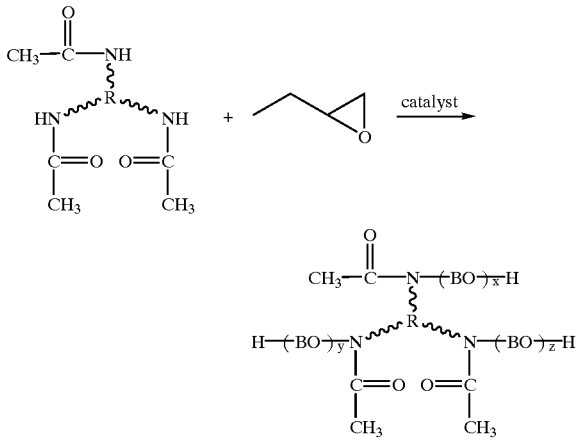

wherein x, y and z are from 1 to 20, and R is poly (oxypropylene) of a molecular weight from 72 to 1000.

The other examples are illustrated in the following tables, in which different Mw of compounds (T-403-triamide-BO) of 1200, 1600, 2000 are shown. (Tables 1 and 2)

TABLE 1

Synthesis of poly(propylene)triamide initiators

| | Substrates | Target Mw | Initial$N_2$ pressure (psi) | Reaction temp° C. | Recovery (%) |
|---|---|---|---|---|---|
| Example 1 | T-403 + EtOAc | 526 | 200 | 180 | 92 |
| Example 2 | T-403 + EtOAc | 526 | 200 | 180 | 93 |
| Example 3 | T-403 + EtOAc | 526 | 200 | 180 | 95 |

EtOAc = Ethyl acetate

TABLE 2

Butoxylation of poly(propylene)triamide

| | Substrates | Target Mw | Catalyst wt % | Initial $N_2$ pressure (psi) | Reaction temp ° C. | GPC (Mw) | Poly-dispersity | Recovery (%) |
|---|---|---|---|---|---|---|---|---|
| Example 1 | T-403-triamide + BO | 1600 | KOH0.2 | 500 | 120 | 1696 | 1.16 | 96 |
| Example 2 | T-403-triamide + BO | 2000 | KOH0.2 | 500 | 120 | 1967 | 1.14 | 96 |
| Example 3 | T-403-triamide + BO | 1200 | KOH0.2 | 500 | 120 | 844 | 1.33 | 96 |

Test Results

In each of the following tests, the base fuel was an unleaded gasoline that contained no additives. The poly (oxyalkylene)triamide alkoxylates gasoline additives were prepared as indicated by Example number and were used at the concentration indicated by mg/l. The tests employed are described below, and the results of the various tests are set forth in the tables below. The following tests may also contain one or more additional detergents. When additional detergents are utilized, the fuel composition will comprise a mixture of a major amount of hydrocarbons in the boiling range described below, a minor amount of the additive compound of the present invention, and a minor amount of an additional detergent selected from polyalkenyl amine, poly(oxyalkylene) carbamate and mixtures thereof. As used herein, the term "minor amount" means less than about 10% by weight of the total fuel composition. The benefits that may be derived by use of carrier fluid and some tests that contain 100 g/l or 200 mg/l hydrocarbon or polyether type carrier fluid were also evaluated.

Intake Valve Coking Simulator (IVCS)

The IVCS test is a measure of the deposit formation on the hot ramp. The results denote the tendency of the additive package to disperse the carbonaceous deposit generated on the film. The deposit simulator results were shown to correlate with BMW intake-valve deposit tests. The test fuels are pumped to an injector consisting of a water-cooled hypodermic needle. The ramp is heated at the elevated end with six electric heaters and is thermally insulated to achieve a temperature difference of 400° C. at the elevated end and 120° C. at the bottom of the ramp. In the IVCS test equipment, since four parallel test cells were employed, four different samples were conducted at the same time. The test conditions are shown in Table 3. The base fuel properties are shown in Table 4.

Before test, stainless steel test films were thoroughly cleaned with solvent (50% n-hexane and 50% acetone). The films were then disposed in an oven at a temperature of 120° C. for 1 hr to remove solvent and water. New test films were weighted and installed, and the tests were run for a period of about 5 hours. At the end of each test, the films were removed, cleaned, and weighted again. Weight gain of the deposit on the film is the IVCS index, reported in mg/250 ml. Generally, the less the deposit formation is, the better will be the intake valve detergency performance of the gasoline or additive tested.

The test samples include the base fuel which contains no additive, the additive compounds prepared from Examples 1 and 2, and some comparative known additives. To evaluate the effect of a carrier fluid in the test samples, a commercially available carrier fluid (polyether, Arco R2152) was added selectively into the test samples. The test results are shown in Table 5.

Thermal Decomposition Test

In order to evaluate the combustion chamber deposit (CCD) performance of the gasoline additive compound of the present invention, a thermal decomposition test was conducted at the test conditions and sequences shown in Table 6. The results of the thermal decomposition test are set forth in Table 7.

It is well known that the less residue at 300° C. is, the better will be the combustion chamber deposit control and low octane requirement increase (ORI) value. OGA-480 controls engine ORI but OGA-472 tends to cause engine ORI. From the above thermal data, Examples 1 and 2 have better performance in CCD control than OGA 480.

Method for Octane Requirement Reduction Testing

The purpose of the octane requirement reduction test is to provide a method of determining the effect of various gasoline components and additives upon the octane requirement of the engine.

The experiment rig mainly consisted of a single-cylinder Waukesha CFR (Cooperative Fuel Research) gasoline engine, pressure transducer, charge amplifier, and a FFT (Fast Fourier Transform) signal analyzer. The critical CFR engine parameters and engine operating conditions are shown in Table 8.

Before the start of the octane requirement reduction (ORR) test, the CFR engine has been dirtied up after running engine test of accumulating over 200 hours. Then the initial octane requirement (ONR) of fuel for the CFR engine is determined by detecting knock. The primary reference fuels (PRF) of a variety of RON blended by isooctane and normal heptane are used for ONR rating fuels. If the light engine knock occurred, the FFT signal analyzer displayed a signal with an amplitude higher than −53 dBVr in spectrum correlated by ear rating. The knock signal of the CFR engine comes out around the frequency of 5.8–6.4 kHz. The criterion of determining the ONR value for the engine was determined on the 25 percentage of light knock occurring at a frequency of 100 continuing power cycles obtained using an intrapolation method.

Then the 30-hour engine ORR test starts to run using base fuel blended with additive. The base fuel properties are shown in Table 9.

The total ORR was calculated as the difference between the ONR numbers of the engine at the beginning and end of the engine test.

At the beginning of the ORR test, the initial ONR of the CFR engine is 90.7 RON. The test results for additives (Example 1) are shown as Table 10. Example 1 shows a good positively affecting the engine octane requirement.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

TABLE 3

| | |
|---|---|
| Test fuel volume: | 250 ml. |
| Test fuel flow: | 0.83 ml./min. |
| Ramp slope: | 5° |
| Stainless steel film | 47 mm W × 1010 mm L × 0.02 mm T |

TABLE 4

| Property | Value |
|---|---|
| IBP* | 40.3° C. |
| 50% BP** | 108.1° C. |
| 90% BP | 163.5° C. |
| Aromatics | 41.6 vol. % |
| Olefins | 2.8 vol. % |
| Saturates | 48.1 vol. % |

TABLE 4-continued

| Property | Value |
|---|---|
| MTBE*** | 7.5 vol. % |
| RON**** | 92 |

*IBP-Initial Boiling Point

**50% BP-Boiling Point at 50% recovery

***MTBE-Methyl Tert-Butyl Ether

****RON-Research Octane Number

TABLE 5

| Compound Example # | Concentration mg/l | Additional Detergent concentration mg/l | Additional Carrier fluid concentration mg/l | Deposit mg/250 ml |
|---|---|---|---|---|
| — | 0 | — | 0 | 12.1 ± 0.3[1] |
| — | 0 | — | 200 | 6.5 |
| 1 | 200 | — | 0 | 44.2 |
| 1 | 200 | — | 200 | 12.9 |
| 2 | 200 | — | 0 | 17.3 |
| 2 | 200 | — | 200 | 5.6 |

[1]0.3 denotes 95% level of confidence interval (24 data points)

TABLE 6

| | |
|---|---|
| Test Sample weight: | 0.2 g |
| Container: | Ceramic Crucible<br>Size: 5 cm diameter, 0.5 cm depth |
| Oven: | Lindberg, Blue M-Model 848 |
| Test sequences: | (I) 90° C., 120 min. Weighting<br>(II) 300° C., 30 min. Weighting<br>(III) 300° C., 60 min. Weighting |

TABLE 7

| Compound Example # | Concentration (wt. %) | Residue (wt. %) 30 min. | Residue (wt. %) 60 min. |
|---|---|---|---|
| 1 | 100 | 1.0 | 0.8 |
| 2 | 100 | 2.2 | 1.8 |
| OGA480[1] | 100 | 4.2 | 2.5 |
| PEA-Texaco[2] | 100 | 6.4 | 4.1 |
| OGA472[3] | 100 | 56.9 | 42.4 |

[1]OGA480-a poly(oxyalkylene)carbamate available commercially from Oronite.
[2]PEA-polyether amine available commercially from Texaco, for comparison use only.
[3]OGA472-polyalkenyl amine available commercially from Oronite.

TABLE 8

| | |
|---|---|
| Engine: | Waukesha, CFR engine<br>612 cc, single cylinder; carburetor |
| Test condition: | Air inlet temperature: 38° C.<br>Compression ratio: 7.0<br>Air/Fuel ratio: 13.5<br>Spark timing: 23 BTDC<br>Cooling temperature: 100° C. |

TABLE 9

| Property | Value |
|---|---|
| IBP | 40.0° C. |
| 50% BP | 108.6° C. |
| 90% BP | 170.5° C. |
| Aromatics | 26.8 vol. % |
| Olefins | 25.1 vol. % |
| Saturates | 48.1 vol. % |
| RON | 95 |

TABLE 10

| Test fuel | New Engine | Dirty-up engine | Base fuel + 200 mg/l Example 1 |
|---|---|---|---|
| RON | 88.6 | | |
| RON at 0 hrs | | 90.7 | |
| RON at 30 hrs | | | 90.1 |
| ORR | | | +0.6 |

We claim:

1. A gasoline additive comprising a compound having the general formula:

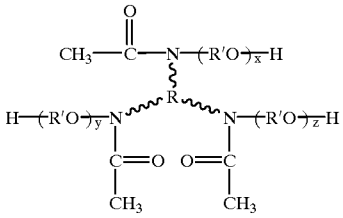

wherein x, y and z are from 1 to 20, R is poly(oxyalkylene) of a molecular weight from 72 to 1000, and R' is an alkyl having a carbon number from 2 to 18.

2. The gasoline additive as claimed in claim 1, wherein the weight average molecular weight of the gasoline additive is from about 600 to 4000.

3. The gasoline additive as claimed in claim 1, wherein R'O is derived from 1,2-epoxybutane.

4. The gasoline additive as claimed in claim 1, wherein R is poly(oxypropylene).

5. A method for producing a gasoline additive comprising a compound having the general formula:

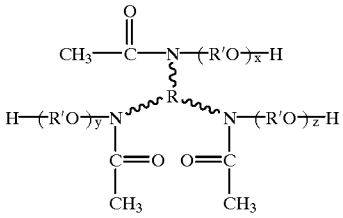

wherein x, y and z are from 1 to 20, R is poly(oxyalkylene) of a molecular weight from 72 to 1000, and R' is an alkyl having a carbon number from 2 to 18, comprising the steps of:

(1) preparing a poly(oxyalkylene)triamide compound having the general formula:

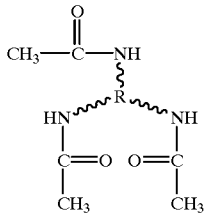

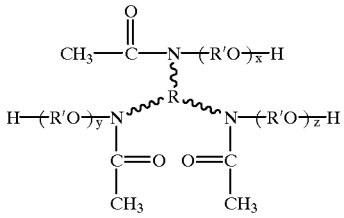

by amidation of an alkyl acetate with a triamine; and (2) alkoxylation of said triamide with 1,2-epoxyalkane.

6. The method as claimed in claim 5, wherein the alkyl acetate is selected from the group consisting of methyl acetate, ethyl acetate, propyl acetate, butyl acetate and C5 to C20 hydrocarbyl acetate.

7. The method as claimed in claim 5, wherein the weight average molecular weight of the additive compound is from about 600 to 4000.

8. The method as claimed in claim 5, wherein R'O is derived from 1,2-epoxybutane.

9. The method as claimed in claim 5, wherein R is poly(oxypropylene).

10. A fuel composition comprising a mixture of a major amount of hydrocarbons in the gasoline boiling range and a minor amount of a gasoline additive comprising a compound having the general formula:

wherein x, y and z are from 1 to 20, R is poly(oxyalkylene) of a molecular weight from 72 to 1000, and R' is an alkyl having a carbon number from 2 to 18.

11. The fuel composition as claimed in claim 10, wherein R'O is derived from 1,2-epoxybutane.

12. The fuel composition as claimed in claim 10, wherein R is poly(oxypropylene).

13. The fuel composition as claimed in claim 10, wherein the weight average molecular weight of the additive compound is from about 600 to 4000.

14. The fuel composition as claimed in claim 10, further comprising detergents selected from the group consisting of polyalkenyl amine, poly(oxyalkylene)carbamate and mixtures thereof.

15. The fuel composition as claimed in claim 10, wherein said additive compound is present in an amount from about 50 ppm by weight to about 500 ppm by weight based on the total weight of the fuel composition.

* * * * *